United States Patent [19]

Elfving et al.

[11] 4,302,880

[45] Dec. 1, 1981

[54] ENGINE REGULATOR FOR A POWER SAW

[75] Inventors: Göran L. Elfving, Lindome; George N. Farquhar, Alingsas, both of Sweden

[73] Assignee: Aktiebolaget Partner, Molndal, Sweden

[21] Appl. No.: 152,134

[22] Filed: May 21, 1980

[30] Foreign Application Priority Data

May 29, 1979 [SE] Sweden ..... 7904657

[51] Int. Cl.[3] ..... B27B 17/00

[52] U.S. Cl. ..... 30/382; 123/398; 123/179 G

[58] Field of Search ..... 30/381, 382, 383; 123/179 G, 339, 398

[56] References Cited

U.S. PATENT DOCUMENTS 3,774,303 11/1973 Burkett et al. ..... 30/382

4,028,804 6/1977 Hammond ..... 30/382

*Primary Examiner*—Jimmy C. Peters

*Attorney, Agent, or Firm*—Alfred E. Miller

[57] ABSTRACT

A regulating arrangement for internal combustion engine-driven tools, such as power saws of the type provided with a handle piece, from the one side of which a finger grip projects connected to the throttle valve of the engine and from the other side of which a middle hand grip and a thumb grip project. The middle hand grip, when the tool is in use, is adapted to release a lock for the finger grip preventing an unintentional opening of the throttle, while the thumb grip is adapted to make it possible to hold the finger grip in a middle position. The middle hand grip and the thumb grip include a common hooking piece, which includes a number of fingers projecting from a rear support of the same, one of said fingers including a forwardly directed hook and the other a backwardly directed dog, which selectively can be brought into engagement and disengagement with a projection on the finger grip.

6 Claims, 3 Drawing Figures

ENGINE REGULATOR FOR A POWER SAW

The present invention relates to a regulating arrangement for internal combustion engine-driven tools, such as power saws, or the like, which includes a handle piece, on the one side of which a finger grip is arranged and mechanically connected to the throttle valve of the engine and spring biased towards an idle position, and on the other side of which a middle hand grip is arranged to keep the finger grip in its idle position, when not actuated. The middle hand grip further functions to release the finger grip, when actuated, into an impressed position, wherein also a thumb grip is arranged in front of the middle hand grip to keep the finger grip in a middle position, when the thumb grip is actuated. Such arrangements are known from, for example, Swedish Patent No. 76,046,283 and U.S. Pat. No. 4,028,804.

A feature of the present invention is to achieve a regulating arrangement of the above-described type comprising as few simple members as possible in manufacturing, and simultaneously being safe in function, as well as in preventing unintentional throttle opening. Thus, the assembly effectively hooks up the finger grip in its middle position, which is necessary for example at the start of the engine, and in resetting the regulating arrangement into the hooked position, when the middle hand grip is released.

The object of the invention is substantially characterized in that the hooking members composed of the middle hand grip and the thumb grip are made of a common hooking piece, with at least two hook fingers protruding from a rear support, of which a first finger positioned adjacent the middle hand side of the handle piece forms a press knob of the thumb grip and a forwardly directed dog, and a second finger is positioned inside the first one and forming a backwardly directed dog, wherein the finger grip member is provided with a projection having a movement way in which said dogs are enterable by pressing the thumb grip down or releasing the middle hand grip, respectively.

An embodiment of the invention is described hereinafter with reference to the accompanying drawings in which.

Figure 1:
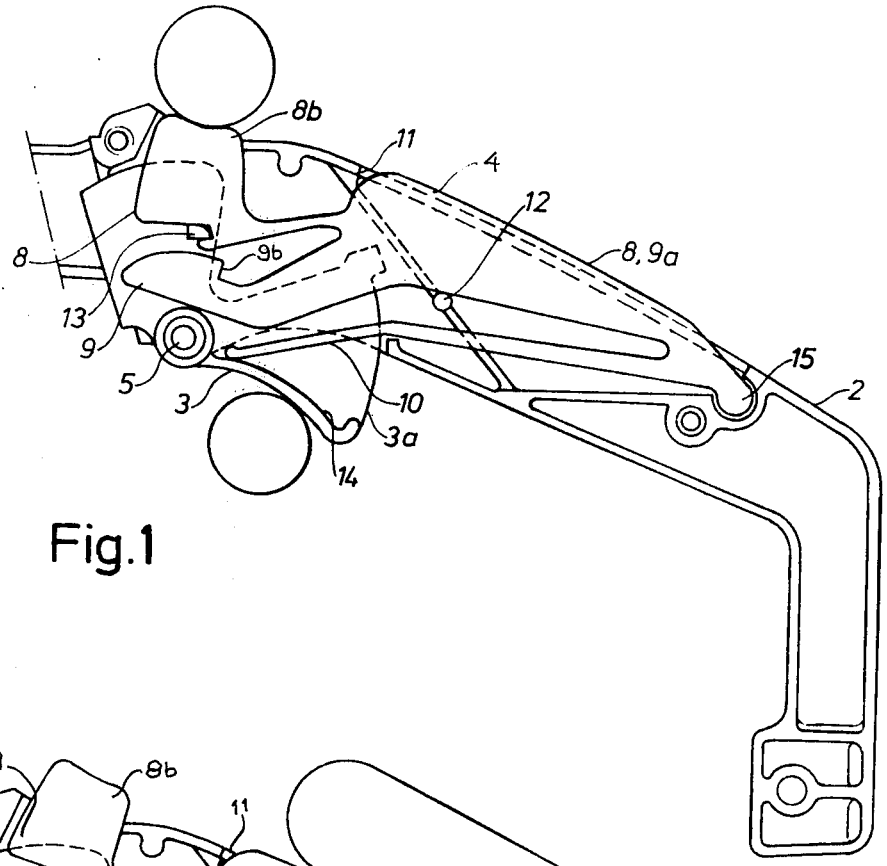
FIG. 1 is a side elevational view showing a regulating arrangement according to the invention mounted in the handle piece of a motor saw, which piece is constructed in two halves, one of which is removed for the purpose of illustration, the regulating arrangement thus being shown in starting position.

In the embodiment shown in the drawings, the entire motor saw body is referred to by the reference numeral 1 and is provided with a backwardly projecting handle piece 2. A regulating arrangement is inserted into the handle piece which is composed of two principal parts, such as a finger grip 3 and a hooking piece 4, which finger grip includes a piece swingably journalled on a shaft 5 affixed to the handle piece 2. The finger grip, as shown in the Figures, is shaped as a two-armed bell crank, one arm 3*a* of which constitutes a cock projecting from the handle piece, and the other arm 3*b* constitutes a transferring arm projecting into the handle piece, and mechanically connected to a throttle valve (not shown) suitably includes a crank portion connecting the bar 6 and projecting member from a carburetor 7, indicated by dashed lines. The hooking piece 4 includes in the direction from a common support member three projecting fingers 8, 9 and 10 of which the fingers 8 and 9 are comparably short and projecting from a common portion 8 and 9*a*, which partly projects through a slot 11 formed in the upper side of the handle grip 2. The projecting portion 8 and 9*a* is so positioned that, in working with the saw, it can be embraced and pressed by the operator's hand. At a distance in front of the portion 8 and 9*a* there is a pressure knob 8*b* on the finger 8 connected with the common piece by means of a flexible spring bridge 8*c*. The underside of the finger 8 includes a forwardly directed hook 8*d*, forming a recess 8*e* between the hook and underside of finger 8, and which is integrated with the rest of the finger. The finger 9 includes a backwardly directed dog 9*b* which in the position shown in FIG. 3 coacts with a side projection 13 on the finger grip 3. The finger 10 has an end which is in contact with a surface 14 on the finger grip 3 due to a pressure created by the resilient property of the material finger 10 is fabricated from. A stop means 12 is arranged crosswise in the handle piece 2, thus restricting movement of the portion 8 and 9*a*. The hooking piece 4 is also fabricated of a resilient material, preferably plastic, and its fastening means 15 is an enlargement which is laterally inserted into a corresponding recess in the handle piece 2. The spring finger 10 biases the finger grip 3 in a clockwise direction toward an end position as seen in the Figures of the drawings, thus setting the throttle valve into its idle position. At the same time, the spring finger 10 functions to swing the two fingers 8 and 9 in an upward direction.

Figure 2:
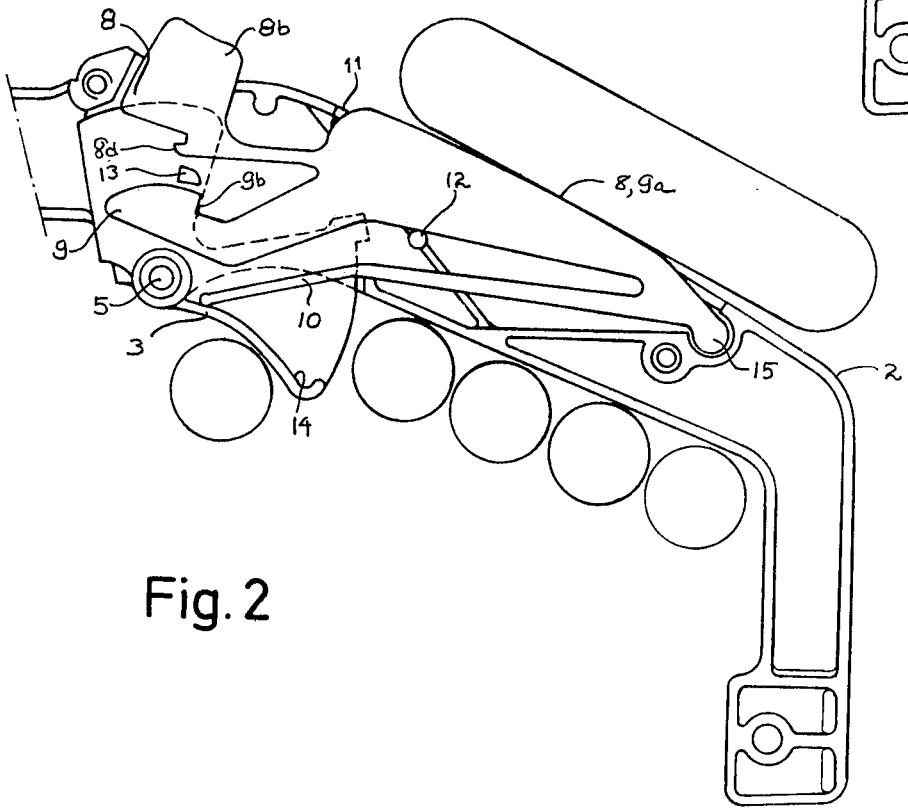
FIG. 2 is a corresponding side elevational view of the same regulating arrangement shown in its working position.
Figure 3:
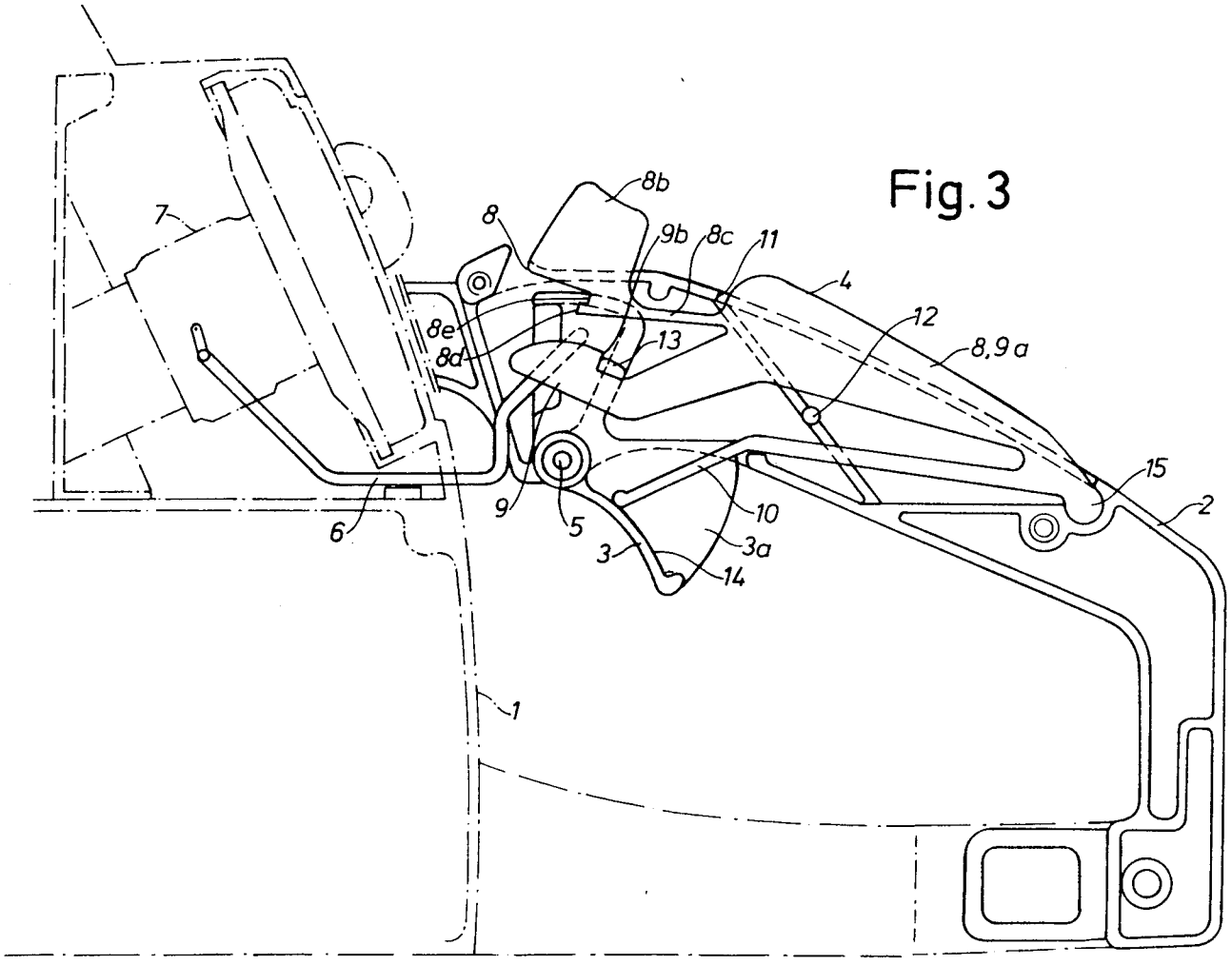
FIG. 3 is a corresponding side elevational view of the arrangement shown in its idle position.

When the saw is initially started, the middle hand grip 8 and 9*a* is depressed simultaneously as the finger grip 3 by pressure thereon is swung down clockwise. Whereupon, the thumb grip is depressed against an increasing spring action. The middle hand grip, in its lower end position, reaches and abuts the stop means 12, and the finger grip 3 is reset so that, as shown in FIG. 1, it comes into engagement with the forwardly directed hook 8*d* of the finger 8. In this location the finger grip is retained in a middle position which is preferable when the power saw is started up. When the hook 8*d* seizes the projection 13 on the finger grip 3 from below, the press knob 8*b* of the thumb grip is prevented from returning to its upper end position, even if the pressure on the same ceases. After some warming up of the engine, the finger grip 3 is pressed somewhat and the hook 8*d* is thereby disengaged from the projection 13, whereby the pressure knob 8*b* is free to return to its upward position. As long as the middle hand grip 8 and 9*a* is pressed, as shown in FIG. 2, the projection 13 thus can move freely in the space between the two fingers 8 and 9, the finger grip 3 can be moved freely to and fro, but as soon as the pressure on the middle hand grip 8 and 9*a* ceases, the projection 13 will drop behind the dog 9*b*, whereby the finger grip is locked in its idle position, as shown in FIG. 3.

The hooking piece 4 includes a comparably stiff middle finger 9 and comparably flexible fingers 8 and 10 on one and the other side of finger 9. In the embodiment shown herein the entire hooking piece is integral, which also includes the springs. The present arrangement has resulted in a decrease in the number of necessary parts of the present assembly, which makes the arrangement quite simple in assembling and inexpensive in manufacturing.

While the invention has been shown and described with reference to a single embodiment, it should be apparent that variations and modifications may be made therein within the spirit and scope of the following claims.

What is claimed is:

1. In an engine regulator for a power saw or the like wherein said engine is provided with a throttle valve, a handle piece for said saw having a finger grip on one side thereof, said finger grip being mechanically connected to said throttle valve of the engine, spring biased means for said finger grip for maintaining said throttle valve in an idle position, said handle being provided with a middle hand grip arranged to maintain said finger grip in its idle position when not actuated, and to release said finger grip when actuated into a depressed position, a thumb grip arranged in front of said middle hand grip to maintain said finger grip in a middle position when said thumb grip is actuated, the improvement comprising: a first hooking member on one part of said middle hand grip and thumb grip, a second hooking member on another part of said hand grip and spaced from said first hooking member, said first and second hooking members being in a common element of said middle hand grip, said middle hand grip including a press knob on said thumb grip, one of said hooking members having a forwardly directed dog and the other of said hooking members being positioned inside said first hooking member and constituting a backwardly directed dog, and a projection on said finger grip member moving in the open space between said first and second hooking members in which said dogs are selectively enterable by said projection upon pressing said thumb grip down or permitting the middle hand grip to move upwardly.

2. An engine regulator as claimed in claim 1 wherein said hooking member including said thumb grip is resilient and flexible in movement against said middle hand grip.

3. An engine regulator as claimed in claim 1 wherein said finger grip further includes a cocking device constituted of a first arm provided on a piece rotatably journalled on a pivot, and a second arm provided thereon carrying said projection wherein said pivot is positioned on a point determined to make the projection move in a direction substantially along with said hooking members.

4. An engine regulator as claimed in claim 1 wherein said common element further includes a flexible finger forming a return spring of the middle hand grip and the thumb grip.

5. An engine regulator as claimed in claim 1 in that said common element is made in one piece of an elastic material.

6. An engine regulator as claimed in claim 1 wherein said hooking members are two hook fingers projecting from said common element.

* * * * *